United States Patent [19]

Combs

[11] Patent Number: 4,989,356

[45] Date of Patent: Feb. 5, 1991

[54] WIND SOCK AMUSEMENT DEVICE

[76] Inventor: Marvin Combs, 2327 Mayhew Dr., Indianapolis, Ind. 46227

[21] Appl. No.: 715,977

[22] Filed: Mar. 25, 1985

[51] Int. Cl.[5] ..... G09F 7/00

[52] U.S. Cl. ..... 40/584; 40/212; 2/171; 2/186

[58] Field of Search ..... 40/214, 215, 610, 212, 40/584, 591, 592, 477, 412, 413, 422; 73/188, 189; 244/153 R; 272/8 N; 116/173, 269; 446/27; 2/171, 174, 185 R, 186, 209.2, 199; 273/34 R

[56] References Cited

U.S. PATENT DOCUMENTS

| | | | |
|---|---|---|---|
| D. 255,576 | 10/1949 | Burch | 273/34 R X |
| 1,025,904 | 5/1912 | Earhart | 116/173 |
| 1,401,626 | 12/1921 | Mader | 73/189 |
| 1,579,034 | 3/1926 | Roberts | 73/189 |
| 1,742,574 | 1/1930 | Breedlove | 73/188 |
| 2,090,121 | 8/1937 | Hayes | 116/173 |
| 2,153,562 | 4/1939 | Hougard | 40/215 |
| 2,203,623 | 6/1940 | Wiemer | 40/215 |
| 2,679,711 | 6/1954 | Learnard | 446/27 |
| 3,071,892 | 1/1963 | Clark | 40/215 |
| 3,399,486 | 9/1968 | Bogaart | 446/27 |
| 3,589,183 | 6/1971 | Ledford | 73/188 |
| 4,488,316 | 12/1984 | Mosca | 2/174 |
| 4,561,301 | 12/1985 | Steele | 272/8 N |

FOREIGN PATENT DOCUMENTS

| | | | |
|---|---|---|---|
| 1038366 | 9/1953 | France | 40/215 |

*Primary Examiner*—Laurie K. Cranmer
*Assistant Examiner*—J. Hakomaki
*Attorney, Agent, or Firm*—Woodard, Emhardt, Naughton Moriarty & McNett

[57] ABSTRACT

An amusement device for enabling a colorful display of one's allegiance to a particular team or entity includes a generally circular hoop member which is provided with a generally cylindrical handle portion, an air-extendable, flexible, fabric sleeve which is hollow throughout having a large opening at one end and a smaller opening at the opposite end and which is securely attached to the hoop member such that the larger opening remains in an open condition. The hoop member further includes a rotational joint which receives the generally cylindrical handle member and which is anchored in place by top and bottom retaining rings securely attached to the handle member, one on each side of the rotational joint of the hoop member. As a circular motion is imparted to the handle member, this motion results in a circular path of the hoop and fabric sleeve, and the interaction of air flow into the hollow sleeve through the hoop results in the hoop and sleeve rotating so as to always receive the incoming air flow. As the air flows into the hollow fabric sleeve, the sleeve is extended such that the sides of the sleeve may be utilized for displaying the name, nickname, logo or emblem of a team or entity.

10 Claims, 4 Drawing Sheets

WIND SOCK AMUSEMENT DEVICE

BACKGROUND OF THE INVENTION

The present invention pertains in general to amusement devices which may be manipulated in some manner by the user. More particularly, the present invention relates to a wind sock amusement device wherein proper manipulation of the device enables the wind sleeve to extend for a colorful display of one's allegiance to a particular team, entity of product item.

It is well known that there is a variety of novelty and souvenir items which one may purchase for the purpose of displaying their allegiance to a particular team, entity or product item. For example, fan of sports teams, whether at the high school, college or professional level, may purchase hats, wearing apparel, banners, buttons, and various noisemakers, all of which usually carry some type of color scheme and/or insignia or emblem so as to identify the particular team.

Over the years there have been numerous variations and modifications to these more traditional novelty, souvenir and clothing items. One modification which comes to mind is the large foam rubber hand which may be worn and is configured with an extended index finger with the intent to symbolize that the particular team is the number one team or first in the nation in a particular sport. A related modification are the large foam hats which are usually arranged in the color scheme for the particular team and in some instances carry the team logo or emblem.

A related article and one which is quite popular for the purpose of displaying one's allegiance to a particular team, are the large flags which are commonly seen at university games as well as attached to vans and recreational vehicles in the parking lots before football games. More recently, towel-waving has become one means of both displaying a team's colors as well as a means to show enthusiasm and hopefully incite and inspire the team.

The present invention while having a similar or related purpose, provides a unique combination of various aspect or characteristics of these earlier types of souvenirs and amusement devices.

The present invention provides a banner, pennant or flag-like article which may be mounted to a an or vehicle. Once mounted in a somewhat stationary manner, the presence of wind or gusts of air extend the sleeve portion thereby making visible the side markings on the sleeve which may include, among other identifiers, a team name, mascot, logo or emblem. The sleeve which is air extendable is provided in the colors of the particular team or entity. Additionally, the present invention may be either worn by the user such as on a headband or cap, or may be held like a pom pom and when the handle portion is rotated the upper hoop portion allows air to be caught or trapped in the sleeve thereby extending the sleeve. The ability to rotate the present invention not only enables the team name or logo to be viewed as the sleeve is extended, but the rotating or whirling action also simulates the now-popular towel-waving and thus accomplished two purposes or objectives somewhat simultaneously.

SUMMARY OF THE INVENTION

An amusement device for enabling a colorful display of one's allegiance to a particular entity or item according to one embodiment of the present invention comprises a generally circular hoop member, an air-extendible, flexible hollow sleeve securely attached to the hoop member, a rotational joint cooperatively arranged with the hoop member and a handle member cooperatively arranged with the rotational joint for enabling rotation of the hoop member relative to the handle member.

One object of the present invention is to provide an improved amusement device.

Related objects and advantages of the present invention will be apparent from the following description.

DESCRIPTION OF THE PREFERRED EMBODIMENT

Figure 1:
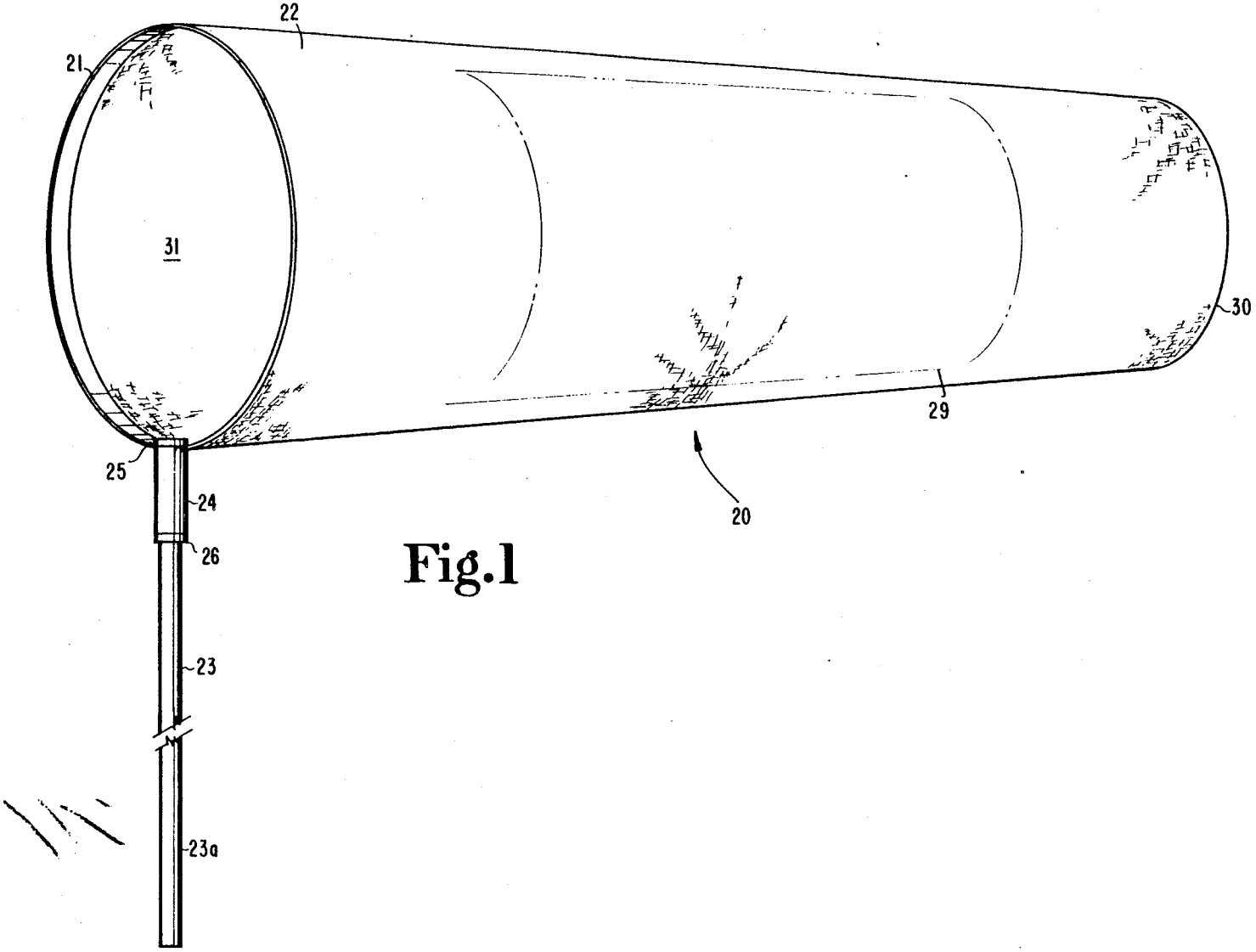
FIG. 1 is a perspective view of an amusement device according to a typical embodiment of the present invention.

For the purposes for promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a wind sock amusement device 20 which includes a generally circular hoop member 21 to which is attached an air-extendible, flexible, hollow sleeve 22. Although the method of attachment of hollow sleeve 22 to hoop member 21 may be by a variety of means, including "Velcro" attachment, snaps or hooks, the method selected for the preferred embodiment is to adhesively bond the hollow sleeve to the outside surface of the hoop member. Another option, though possibly more costly is to take the fabric of the hollow sleeve, wrap it around the hoop member so that the leading edge of the hollow sleeve and the adjacent body portion of the hollow sleeve are placed in contact with each other adjacent the hoop member at which location the two layers of fabric are sewn together. The advantage of this immediately foregoing method of assembly is to eliminate any possible open edges, gaps or seam interfaces between the inside surface of the hollow sleeve fabric and the outside surface of the hoop member. Thus, this sewn assembly technique is preferred for applications where amusement device 20 may be subjected to extremely high winds or air forces.

Amusement device 20 also includes a generally cylindrical handle portion 23 which is attached to the hoop member by means of a hollow cylindrical fitting 24. As is illustrated in the exemplary embodiment fitting 24 is rigidly secured to hoop member 21 and is molded as part of the hoop member when the hoop member is molded from plastic, preferably by injection molding. Although there is a sliding or rotary fit between the handle portion 23 and fitting 24, it being understood that the outside diameter of the handle portion is slightly smaller than the inside diameter of the fitting, the relationship between these two components and the hoop member are maintained by top retaining ring 25 and bottom retaining ring 26. Although bottom retaining ring 26 may be rigidly secured to handle portion 23 prior to insertion of the handle portion into the interior cylindrical opening of fitting 24, top retaining ring 25 must be assembled after insertion into fitting 24. As should be understood, there is an opening in hoop member 21 which is aligned with the cylindrical opening in fitting 24 such that the end of the handle portion 23 which extends upwardly through the fitting also extends through the opening in the hoop member and it is this distal free end of the handle portion which receives top retaining ring 25.

By providing a slight clearance between fitting 24 and the inserted portion of handle portion 23, it is to be understood that the hoop is able to rotate about the longitudinal axis of handle portion 23. This rotational motion to hoop member 21 is created by a fairly rapid, small circular motion being imparted to the proximal end 29 of handle portion 23. Due in part to the slip fit of the handle portion within fitting 24, the fact that fitting 24 rests upon bottom retaining ring 26 and the fact that as circular motion is imparted to the handle portion there is a transfer of this circular motion to the hoop, the hoop member with the hollow sleeve attached is able to rotate generally on axis as the small radiused and fast circular motion is imparted to the handle portion.

While the rotation of hoop member 21 occurs, there may be also a slight circular movement or pattern transmitted to the entire amusement device. As a result, air or wind is caught by the hollow sleeve causing it to inflate and extend to the extended orientation which is illustrated in FIG. 1. As the circular pattern of movement with the handle portion continues, the hoop member also moves in a circular pattern thereby drawing in a flow of air sufficient to inflate and extend the hollow sleeve.

In the extended and inflated condition, sleeve 22 provides a sufficient surface area on the exterior of the fabric from which the sleeve is made so that a team name or logo may be applied. Area 29 which is outlined in broken or phantom line form is intended to illustrate that portion on the exterior surface of the fabric where team names, logos or emblems may be placed and will be fully visible by all those watching the utilization of device 20 when the sleeve is extended. Further, the fabric which is utilized for hollow sleeve 22 may be color coordinated for the particular team, entity or product which is being publicized by the device. It is also possible to put names, emblems or logos on both sides of the hollow sleeve as well as on the top and bottom. As should be understood, with hollow sleeve 22 being made of a flexible and relatively thin fabric, when there is not air flow through hoop member 21, the hollow sleeve will not be extended.

Further, end 30 is open at all times thereby allowing the air flow into the center opening 31 of the hoop member which also coincides with the open end of the hollow sleeve. The hollow and open nature of sleeve 22 means that the entering air (or wind) will encounter only minimal resistance as it flows through from opening 31 to open end 30. Nevertheless, this flow of air through hollow sleeve 22 is sufficient to extend the generally conical fabric walls to the air-extended orientation illustrated in FIG. 1.

Figure 2:
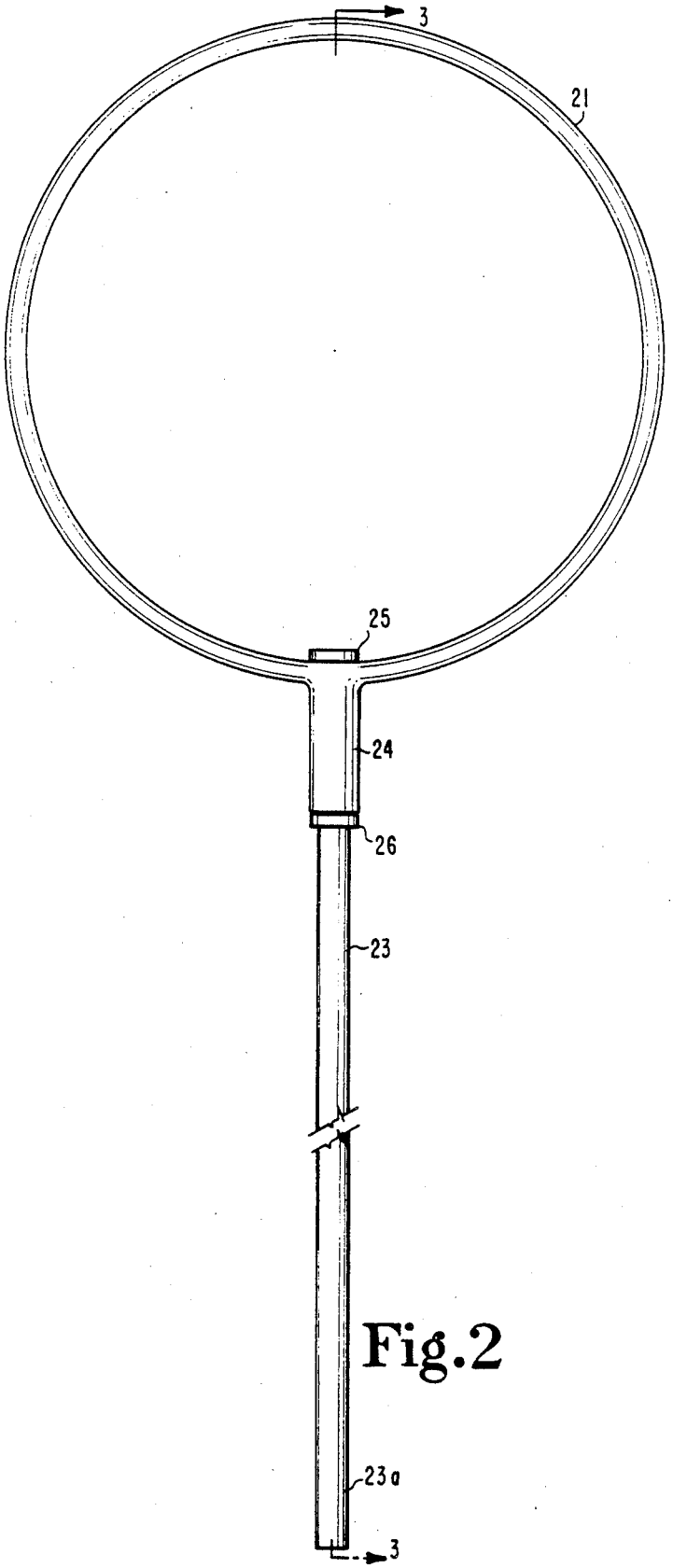
FIG. 2 is a fragmentary, front elevation view of the FIG. 1 amusement device.
Figure 3:
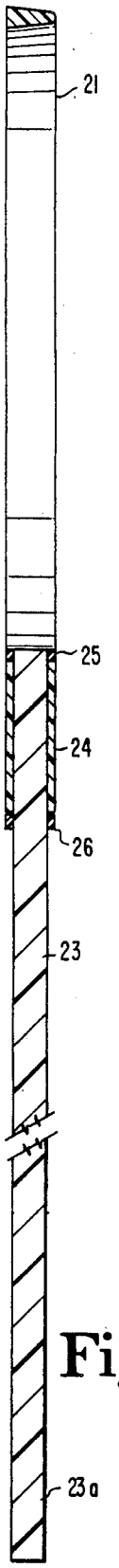
FIG. 3 is a fragmentary, side elevation view of the FIG. 1 amusement device.

FIGS. 2 and 3 are front and side elevation views, respectively, of the FIG. 1 device with hollow sleeve 22 removed. As should be understood, hoop member 21 is relatively thin as to its front-to-back width though it is of sufficient dimension to provide a suitable attachment surface for the hollow sleeve. Similarly, it can be seen from the FIG. 3 side elevation illustration that fitting 24, although cylindrical in nature, has approximately the same outside diameter size as the width or thickness dimension of the hoop member.

The utilization of device 20 which has been described so far relates generally to manual operation whereby some type of rotary or circular motion must be imparted to handle portion 23 and from there through fitting 24 and on to hoop member 21 in order to get the hoop member moving or rotating in a circular pattern. Although the assembly between handle portion 23 and fitting 24 could be rigid rather than a sliding or rotary fit, it is important to provide rotational means at that location so that as hoop member 21 moves in a circular pattern, opening 31 is oriented in a manner such that it always meets the incoming air flow. If there was not a rotary relationship between fitting 24 and handle 23, then for certain portions of the circular path of hoop member 21, opening 31 would not be oriented in the direction of movement but would rather be at some angle thereto thus minimizing if not totally preventing the ability of the passing air flow to actually enter through opening 31 in order to inflate and extend hollow sleeve 22. In fact, it is the air flow through the hollow sleeve which assists in rotating the hoop member relative to the handle portion. As the circular path of the amusement device changes, the entering air flow is gradually directed against the interior sides of the hollow sleeve resulting in some resistance and a modest force being exerted on the sides of the hollow sleeve so as to cause rotation of the hoop member. This slight interior air force which is directed against the inner sides of the hollow sleeve maintains opening 31 in an orientation which constantly faces the incoming air flow in a somewhat maximum open condition.

This rotation due in part to entering air flow is similar in concept to conventional meteorological wind socks which may be utilized at airports and related establishments to determine and show the direction of wind and to some degree the velocity of the wind. The more fully the wind sock is extended in a horizontal orientation, the greater the wind force, though this particular device more appropriately measures the wind direction than the wind velocity. However, the hoop portion on a conventional meteorological wind sock is able to turn so as to face the direction of the wind and as that direction changes, the air force against the interior sides of the sleeve enable the hoop opening to be turned so that at all times the hoop opening faces the maximum wind velocity direction.

In the event amusement device 20 is utilized more as a conventional wind sock and less as a hand-held rotary device, various alternatives or attachment modifications are envisioned.

Figure 4:
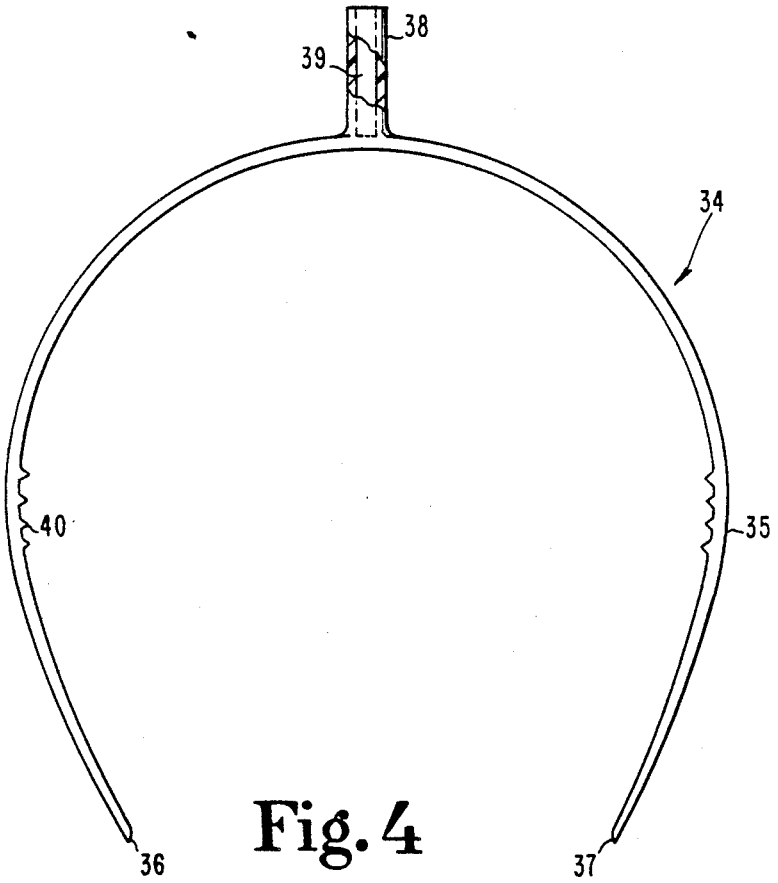
FIG. 4 is a front elevation view of one headband style usable as support means with the FIG. 1 amusement device.

Referring to FIG. 4, a substantially rigid headband 34 is disclosed which includes a band portion 35 terminating in free ends 36 and 37. Rigidly attached at the top or uppermost portion of headband 34 is a handle-receiving stem 38 which includes a generally cylindrical interior opening 39. A s should be understood, the generally circular configuration of band 35, though not extending a full 360° to a closed condition, does extend in a circular arrangement sufficiently such that it may be inserted over the head of a user and be held in position. Headband 34 is fabricated of a relatively flexible material such that although the band material is substantially rigid, the band as a whole may flex or expand as to the distance of separation between free ends 36 and 37. Consequently, one size of headband will generally fit all head sizes and since ends 36 and 37 must be expanded in order to be worn, there is a certain spring-back or contraction force which is applied to the head of the user thereby keeping the headband in place. In order to provide additional assistance for keeping the headband in place, the interior surface of band 35 is provided with two rows of teeth 40 which are integrally and homogeneously molded as part of band 35 and extend inwardly only a slight distance so as not to cause discomfort, but to provide a type of penetrating or gripping surface into the hair of the user.

As should be understood, headband 34 is to be worn much like a conventional hair band which a lady may use to pull her hair rearwardly away from her face and then pin it or secure it in that orientation. With the present headband, the ability to hold amusement device 20 is provided by the addition of stem 38 with its interior cylindrical opening. This stem is suitably sized and arranged so as to receive the proximal end 23*a* of handle portion 23. In particular, cylindrical opening 39 is sized compatibly with the outside diameter of proximal end 23*a* so as to receive the handle portion therein with a snug and secure sliding fit. By providing stem 38 with sufficient vertical height, there is an adequate anchoring dimension so that the handle portion of device 20 can fit securely into the stem and securely hold the entire amusement device 20 on the head of the individual wearing headband 34.

Figure 5:
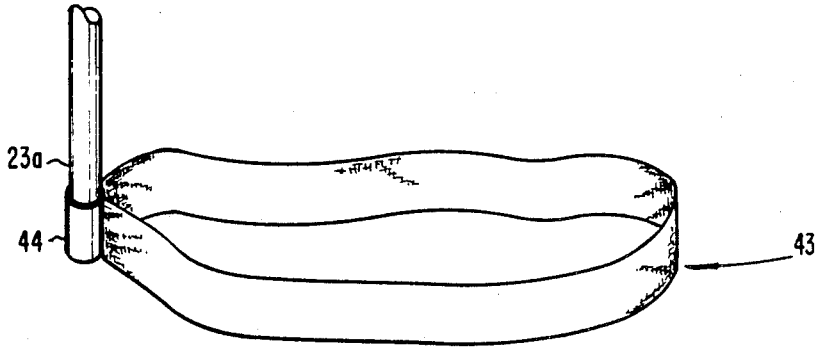
FIG. 5 is a side elevation view of a support member attachment suitable for use with the FIG. 1 amusement device when worn by a hat or similar item of apparel.

As should be understood, the FIG. 4 headband is to be worn over the top of the user's head rather than around the head. Referring to FIG. 5, a flexible cloth headband 43 is illustrated which in the exemplary embodiment has a generally elastic nature so that it slips over the head and such that one size fits virtually everyone's head. Disposed on one side of headband 43 is a sleeve fitting 44 which is styled and arranged very similar to stem 38. Sleeve fitting 44 also includes an interior cylindrical opening which is compatibly sized so as to receive proximal end 23*a* of handle portion 23. Again, somewhat similar to the design and style of stem 38, sleeve 44 has a sufficient height or depth so as to securely receive the handle portion therein in order to maintain and support the amusement device in its proper upright orientation. The arrangements of both FIGS. 4 and 5 provide a type of head gear support means for wearing device 20. These same concepts may be extended to hats and caps though at some point, it may be desirable to allow the wearing of amusement device 20 as an option. Consequently, it is envisioned that sleeve fitting 44 may be configured with "Velcro" means such that the fitting could be selectively added or deleted from a hat, cap or headband.

Figure 6:
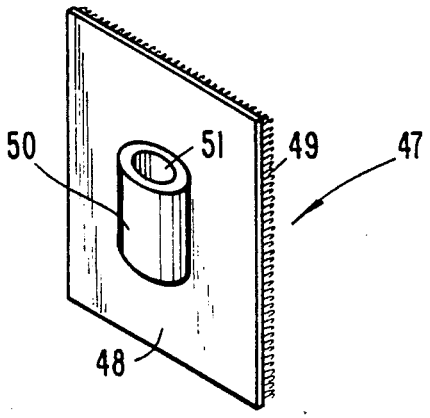
FIG. 6 is a front elevation view of an alternate headband style suitable as support means for the FIG. 1 device.

Referring to FIG. 6, there is illustrated an attachable and removable sleeve fitting 47 which includes a panel 48, the back side of which is fitted with one-half of the synthetic hooks and loops fastener system referred to as "Velcro." On the opposite side from the "Velcro" 49 is a cylindrical sleeve 50 which has interior thereto a cylindrical opening 51. As has been previously described, sleeve 50 and cylindrical opening 51 are suitably sized and arranged so as to receive the proximal end 23*a* of handle portion 23. In this manner, by attaching "Velcro" 49 to the corresponding other half of the "Velcro" fastening system, system fitting 47 may be attached to virtually any article and once attached provides a receiving opening for amusement device 20. All that need be done to utilize amusement device 20 and sleeve fitting 47 is to provide at some point on apparel or any object a matching and mating patch of "Velcro."

Figure 7:
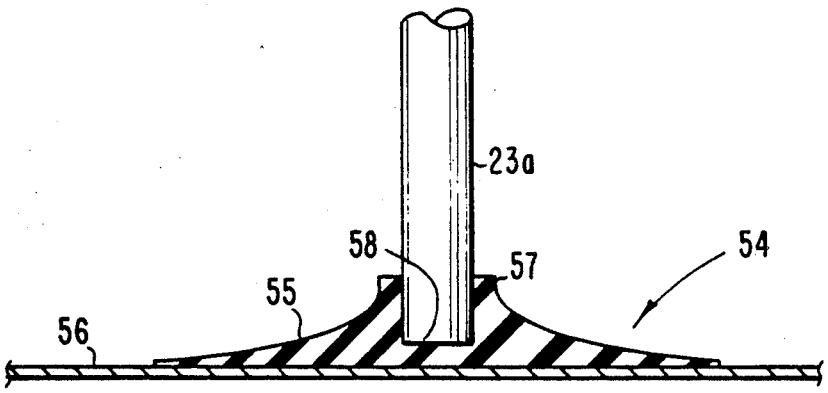
FIG. 7 is a front elevation view of a suction cup mounting for supporting the FIG. 1 amusement device.

Referring to FIG. 7, another alternative for the support of amusement device 20 is disclosed. Suction cup 54 includes a base portion 55 which has a substantially hollow underside for suction attachment to a substantially smooth and rigid surface 56. The center and interior portion of suction cup 54 is provided with an upwardly extending and generally cylindrical sleeve 57 which includes, centrally disposed therein, a generally cylindrical receiving opening 58. Opening 58 is compatibly sized and arranged for receipt of proximal end 23*a* of handle portion 23. When reference is made to compatibly sized and arranged, it is to be understood that insertion of handle portion 23 into the receiving opening of those various sleeves of fittings disclosed in FIGS. 4–7 is intended to be a snug and tight sliding fit so that with a generally rigid side wall surrounding the cylindrical opening, once the amusement device handle portion is inserted in the opening, the amusement device will remain in an upright orientation or at least in an orientation corresponding to the direction of the opening and will not sag or tilt. In order to assure that once the amusement device is inserted, it will not sag or tip over, it is important that the cylindrical opening have a sufficient height so as to able to receive a sufficient length of the handle portion to provide the support and stability necessary. It is also important that the surrounding wall of the sleeve or fitting which defines the cylindrical opening be of a sufficient wall thickness and material so as to provide the necessary strength and rigidity for holding the amusement device in an upright orientation.

While the arrangements of FIGs. 4, 5 and 6 pertain primarily to means for wearing amusement device 20 either on head gear or clothing, the arrangement of FIG. 7 is designed specifically to attache amusement device 20 to surfaces such as automobile hoods, the tops of vans or recreational vehicles or on countertops or other substantially smooth and rigid surfaces. For example, since one very popular utilization of devices such as pennants, banners or flags is to attach them to recreational vehicles while parked for football games, it is envisioned that the use of the suction cup 54 of FIG. 7 could be utilized to secure any number of amusement devices to vehicles of this type during football games. It should also be noted that while these alternate means may be used, at any time the user desires, the amusement device may be pulled from its holder and used manually in the rotating, circular pattern previously described.

Although the construction of amusement device 20 has generally been described as a molded plastic construction with a cloth or fabric sleeve, it should also be understood that a variety of materials may be suitable and a variety of fabrics may be utilized for the sleeve. Although molding is believed to be a low-cost and reliable method of manufacturing, larger versions of the device may necessitate certain changes simply to provide the strength and rigidity. For example, larger amusement devices of the type described herein which may be incorporated on moving vehicles, may necessitate conversion of the suction cup or other support means to a metal bracket and replace the handle portion and hoop member with metal members for added strength.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An amusement device for enabling a display of one's allegiance to a particular team or entity comprises:

a hoop member;

an air-extendable, flexible, hollow sleeve securely attached to said hoop member;

a rotational joint cooperatively arranged with said hoop member; and a handle member cooperatively arranged with said rotational joint for enabling rotation of said hoop member relative to said handle member.

2. The amusement device of claim 1 wherein said hoop member is generally circular.

3. The amusement device of claim 1 wherein said handle member is generally cylindrical.

4. The amusement device of claim 1 wherein said rotational joint includes a substantially cylindrical sleeve defining a substantially cylindrical opening therein and which is rigidly secured to said hoop member.

5. The amusement device of claim 1 which further includes support means for said handle member, said support means being designed and arranged to be worn by the user of said amusement device and adapted for removable receipt of said amusement device.

6. The amusement device of claim 5 wherein said hoop member is generally circular.

7. The amusement device of claim 5 wherein said handle member is generally cylindrical.

8. The amusement device of claim 5 wherein said rotational joint includes a substantially cylindrical sleeve defining a substantially cylindrical opening therein and which is rigidly secured to said hoop member.

9. The amusement device of claim 5 wherein said support means includes a headband provided with a receiving sleeve for said handle member.

10. The amusement device of claim 5 wherein said support means includes a suction cup suitably designed and arranged for receipt of said handle member.

* * * * *